US009988164B2

(12) United States Patent
Harms et al.

(10) Patent No.: US 9,988,164 B2
(45) Date of Patent: Jun. 5, 2018

(54) METHOD AND DEVICE FOR PRODUCING A PACKAGE FOR A GROUP OF SMOKABLE ARTICLES

(75) Inventors: Stefan Harms, Hamburg (DE); Marc-Daniel Stegen, Hamburg (DE); Jan Riepenhusen, Hamburg (DE)

(73) Assignee: Focke & Co. (GmbH & Co. KG), Verden (DE)

( * ) Notice: Subject to any disclaimer, the term of this patent is extended or adjusted under 35 U.S.C. 154(b) by 992 days.

(21) Appl. No.: 14/347,263

(22) PCT Filed: Jul. 18, 2012

(86) PCT No.: PCT/EP2012/003030

§ 371 (c)(1),
(2), (4) Date: Jun. 24, 2014

(87) PCT Pub. No.: WO2013/045006

PCT Pub. Date: Apr. 4, 2013

(65) Prior Publication Data

US 2014/0311096 A1 Oct. 23, 2014

(30) Foreign Application Priority Data

Sep. 29, 2011 (DE) ..... 10 2011 114 522

(51) Int. Cl.
*B65B 19/22* (2006.01)
*B65B 61/20* (2006.01)
(Continued)

(52) U.S. Cl.
CPC ..... *B65B 19/22* (2013.01); *B05C 5/0279* (2013.01); *B05C 11/023* (2013.01); *B65B 11/08* (2013.01);
(Continued)

(58) Field of Classification Search
None
See application file for complete search history.

(56) References Cited

U.S. PATENT DOCUMENTS 2,558,773 A * 7/1951 Mulloy ..... B05C 3/18 118/101
3,906,893 A 9/1975 Scales
(Continued)

FOREIGN PATENT DOCUMENTS

DE 19535649 A1 3/1997
DE 10361796 A1 9/2006
(Continued)

OTHER PUBLICATIONS

Japanese Patent Office, Official Action (in a related patent application), dated Aug. 31, 2016.
(Continued)

*Primary Examiner* — Hemant M Desai
*Assistant Examiner* — Tanzim Imam
(74) *Attorney, Agent, or Firm* — Laurence P. Colton; Smith Tempel Blaha LLC

(57) ABSTRACT

A device and a method for manufacturing an item of packaging for a group (27) of smokable articles (11), in particular cigarettes, having a wrapping, preferably an inner wrapping, of, in particular, a thin packaging material, such as paper, tinfoil or the like, in which a material web (31) of the packaging material is severed into individual blanks (10) and in which the article groups (27) to be wrapped are in each case wrapped with the individual blanks (10). Flavoring and/or aromatic portions (42) for the smokable articles are applied to the packaging-material web (31), which flavoring and/or aromatic portions (42), after application, are at least in regions reduced in their height by a processing
(Continued)

means, preferably in that they are spread flat and/or pressed flat by the processing means (47).

10 Claims, 4 Drawing Sheets

(51) Int. Cl.

| | |
|---|---|
| ***B65B 11/08*** | (2006.01) |
| ***B05C 5/02*** | (2006.01) |
| ***B05C 11/02*** | (2006.01) |
| ***B65B 41/16*** | (2006.01) |
| ***B65B 57/08*** | (2006.01) |
| ***B65B 61/08*** | (2006.01) |

(52) U.S. Cl.
CPC ..... *B65B 19/221* (2013.01); *B65B 41/16* (2013.01); *B65B 57/08* (2013.01); *B65B 61/08* (2013.01); *B65B 61/20* (2013.01)

(56) References Cited

U.S. PATENT DOCUMENTS

| | | | | | |
|---|---|---|---|---|---|
| 3,982,375 | A * | 9/1976 | Focke | B65B 11/58 | 53/228 |
| 4,025,671 | A * | 5/1977 | Creamer | B05C 5/027 | 118/221 |
| 4,068,614 | A * | 1/1978 | Kopachkov | B05C 5/027 | 118/210 |
| 4,351,142 | A * | 9/1982 | Focke | B65B 19/228 | 53/228 |
| 4,603,534 | A * | 8/1986 | Focke | B65B 41/06 | 493/113 |
| 4,909,020 | A * | 3/1990 | Focke | B65B 41/10 | 53/202 |
| 4,960,234 | A * | 10/1990 | Focke | B65B 41/12 | 226/15 |
| 5,534,114 | A * | 7/1996 | Cutright | B05C 5/027 | 118/315 |
| 5,656,326 | A * | 8/1997 | Mallinson | B05C 5/0245 | 118/101 |
| 5,788,775 | A * | 8/1998 | Boriani | B05B 13/0463 | 118/315 |
| 5,918,440 | A * | 7/1999 | Focke | B65B 41/06 | 53/228 |
| 6,093,248 | A * | 7/2000 | Kohl | B05C 3/125 | 118/117 |
| 6,095,959 | A * | 8/2000 | Negrini | B08B 1/02 | 493/327 |
| 6,523,682 | B1 * | 2/2003 | Focke | B65B 19/221 | 206/273 |
| 6,658,822 | B1 * | 12/2003 | Dittrich | B65B 61/00 | 131/274 |
| 6,692,835 | B1 | 2/2004 | Tomel | | |
| 7,325,368 | B2 * | 2/2008 | Miyaoka | B65B 19/228 | 53/167 |
| 8,047,362 | B2 | 11/2011 | Pham | | |
| 2003/0014947 | A1 | 1/2003 | Deevi | | |
| 2004/0161531 | A1 * | 8/2004 | Ferber | B65B 51/023 | 427/207.1 |
| 2007/0102014 | A1 * | 5/2007 | Hafker | A24C 5/608 | 131/280 |
| 2008/0280028 | A1 * | 11/2008 | Albrecht | B41J 3/28 | 427/8 |
| 2010/0251671 | A1 * | 10/2010 | Thompson | B65B 63/08 | 53/440 |
| 2012/0032157 | A1 * | 2/2012 | Kawabe | B05D 5/06 | 257/40 |
| 2012/0038084 | A1 * | 2/2012 | Lee | B29C 33/40 | 264/293 |
| 2012/0064224 | A1 * | 3/2012 | Wang | G02F 1/1303 | 427/8 |

FOREIGN PATENT DOCUMENTS

| | | | | | |
|---|---|---|---|---|---|
| DE | 102005056627 | | * | 5/2007 | B65B 19/228 |
| DE | 102009058589 | A1 | | 10/2010 | |
| EP | 1016593 | A1 | | 7/2000 | |
| JP | H6-254465 | A | | 9/1994 | |
| JP | H8-182955 | A | | 7/1996 | |
| JP | H08182955 | A | * | 7/1996 | |
| JP | H11-307087 | A | | 11/1999 | |
| JP | 2000-118510 | A | | 4/2000 | |
| JP | 2000118510 | A | * | 4/2000 | |
| JP | 2003-211066 | A | | 7/2003 | |
| JP | 2003211066 | A | * | 7/2003 | |
| WO | 2000/48907 | A1 | | 8/2000 | |
| WO | 2005-007512 | A1 | | 1/2005 | |
| WO | WO 2009146766 | A1 | * | 12/2009 | B05C 5/0279 |
| WO | 2010-031467 | A1 | | 3/2010 | |

OTHER PUBLICATIONS

WIPO/PCT, International Search Report for PCT/EP2012/003030, dated Nov. 2, 2012.

Deutsches Patent—Und Markenamt, Recherchebericht (Search Report on priority German Patent Application No. 10 2011 114 522.6), dated Jun. 29, 2012.

State Intellectual Property Office of the People's Republic of China, Notification of the Third Office Action (in a related case), dated Feb. 20, 2017.

State Intellectual Property Office of the People's Republic of China, Notification of the First Office Action, dated Sep. 2, 2015.

* cited by examiner 10
11
12
13
14
15
16
17
18
19
20
21
22
24
25
26
42
46a
46b
46c
46d
53

METHOD AND DEVICE FOR PRODUCING A PACKAGE FOR A GROUP OF SMOKABLE ARTICLES

STATEMENT OF RELATED APPLICATIONS

This patent application claims the benefit of International Patent Application No. PCT/EP2012/003030 having an International Filing Date of 18 Jul. 2012, which claims the benefit of German Patent Application No. 10 2011 114 522.6 having a filing date of 29 September.

BACKGROUND OF THE INVENTION

Technical Field

The present invention relates to a method for manufacturing an item of packaging for a group of smokable articles, in particular cigarettes, having a wrapping, preferably an inner wrapping, of, in particular, a thin packaging material, such as paper, tinfoil or the like, in which a material web of the packaging material is severed into individual blanks and in which the article groups to be wrapped are in each case wrapped with the individual blanks, and to a device for manufacturing an item of packaging for a group of smokable articles, in particular cigarettes, having a wrapping, preferably an inner wrapping, of, in particular, a thin packaging material, such as paper, tinfoil or the like, in particular for the implementation of the method disclosed herein, having a severing element, with which a material web of the packaging material is severable into individual blanks, and having a blank subassembly, in the region of which the article groups are wrappable with the individual blanks in each case.

Prior Art

In the context of the manufacture of cigarettes it is known to add flavorings and/or aromatics to the cigarettes. It is known, for example, to provide a web-shaped material for an (inner) wrapping of a cigarette pack with a menthol layer already prior to the manufacture of the cigarette pack. The menthol layer here is applied to that side of the web-shaped wrapping material that, in the finished cigarette pack at a later stage, faces inward and here covers the cigarette group at least in regions. Menthol can subsequently flow from the wrapping into the cigarettes. The material webs here are wound onto reels by the manufacturer of such webs and subsequently shipped to the cigarette producers. The latter use these reels in the context of cigarette pack production and supply these as a primary material to the packaging machines.

It is disadvantageous here that, on account of winding the material webs provided with the menthol layer onto the reels, menthol is often unintentionally transferred from the coated outer side of a wound layer, which is arranged farther inside, to the inner side of the subsequent wound layer (or vice-versa, if applicable). In other words, on account of this, the supposedly uncoated sides of the material web are contaminated with menthol. The menthol crystals then have to be laboriously removed again from the "wrong" material-web side during the production process of the cigarette packs, since otherwise the widest variety of elements of the respective packaging machine will be unintentionally contaminated by the menthol crystals.

BRIEF SUMMARY OF THE INVENTION

The invention is based on the object of proposing measures with which such contamination of the packaging machine can be avoided or reduced.

This object is achieved by a method for manufacturing an item of packaging for a group of smokable articles, in particular cigarettes, having a wrapping, preferably an inner wrapping, of, in particular, a thin packaging material, such as paper, tinfoil or the like, in which a material web of the packaging material is severed into individual blanks and in which the article groups to be wrapped are in each case wrapped with the individual blanks, and a device for manufacturing an item of packaging for a group of smokable articles, in particular cigarettes, having a wrapping, preferably an inner wrapping, of, in particular, a thin packaging material, such as paper, tinfoil or the like, in particular for the implementation of the method disclosed herein, having a severing element, with which a material web of the packaging material is severable into individual blanks, and having a blank subassembly, in the region of which the article groups are wrappable with the individual blanks in each case.

Accordingly, a method for manufacturing an item of packaging for a group of smokable articles, in particular cigarettes, having a wrapping of a thin packaging material, in which a material web of the packaging material is severed into individual blanks and in which the article groups to be wrapped are in each case wrapped with the individual blanks, is characterized in that flavoring and/or aromatic portions for the smokable articles are applied to the packaging-material web, which flavoring and/or aromatic portions, after application, are at least in regions reduced in their height by a processing means, preferably in that they are spread flat and/or pressed flat by the processing means.

It is accordingly provided to immediately apply the flavoring and/or aromatic portions to the packaging/material web in the packaging process and to subsequently reduce the individually applied portions in their height by a suitable processing means or to spread them flat and/or press them flat, in order to hereby prevent contamination of the downstream elements. Without the portions being spread flat and/or pressed flat as mentioned, there would otherwise be the risk of all subsequent subassemblies being polluted with the flavoring and/or aromatic.

This applies, in particular, to a severing element, with which the individual blanks are severed from the continuous material web. The severing element is often a knife roller, the knives of which would otherwise be contaminated.

Therefore, the processing means is preferably located upstream of the severing element, in particular between an application element, having one or more application valves with which the portions are applied to the material web, and the severing element.

It is expedient for the portions to be applied to that side of the packaging-material web that, after the wrapping operation, faces inward in the direction of the article group. The cigarette group here may be partially or completely wrapped by the wrapping. The wrapping is preferably an inner wrapping, of tinfoil, paper or foil, of a cigarette pack which additionally still has a corresponding outer wrapping, or outer packaging, in which the inner wrapping is arranged.

The processing means is preferably a heated or heatable roller, in particular a deflection roller, which is arranged downstream of the application element and along which the material web, after application of the portions, is guided for pressing flat said portions. For this purpose, the material web is guided, preferably under slight tension, along a part-region of the circumference of the roller and is at least slightly deflected in the process.

Alternatively, the processing means also may be at least one strip, or comprise such a strip, with which the portions can be spread flat, in particular smoothed flat. In an expedient manner, the strip is guided parallel to the material web, of course adjacent to that side to which the portions are applied. In a similar manner to the abovementioned solution having the deflection roller, the material web is preferably guided under slight tension along the strip and is likewise at least slightly deflected in the process.

The strip here preferably forms part of a nozzle of the valve of the application element. An inner nozzle surface, which is arranged adjacent to the nozzle opening and downstream of the nozzle opening, is preferably formed by the strip, or by one side of the strip.

If the application element comprises a plurality of adjacent valves which are arranged transversely to the material-web conveying direction, the corresponding inner nozzle surface of each nozzle of each valve may be formed in this manner by a strip which is assigned collectively to all valves.

According to a further important special feature of the invention, the application of the portions to the material web takes place in such a manner that the total amount of the individual portions applied per blank to the material web remains constant, irrespective of the machine speed of the device and/or the material-web speed. It may be provided here that in the case of an identical total amount per portion per blank, the number of individual portions which are applied to a blank is a result of the requirement of the machine speed and/or the material-web speed. In a further configuration of this embodiment it is provided that, in the case of an identical total amount per portion per blank, more individual portions per blank are applied to the material web at a first, lower machine speed and/or material-web speed than at a second, higher speed.

These measures have the purpose of, in particular, preventing too much flavoring and/or aromatic from accumulating at one and the same point in the case of, for example, an (excessively) slow machine speed.

Further special features of the invention emerge from the appended dependent claims, from the following description of preferred exemplary embodiments and from the appended drawings.

DETAILED DESCRIPTION OF PREFERRED EMBODIMENTS

The drawings concern the production of cigarette packs, especially the production of an inner wrapping of tinfoil, paper or foil for the cigarette packs. Mainly hinge-lid packs or soft-carton packs have an inner wrapping of this type, which is enveloped by an outer wrapping. Such cigarette packs are produced by packaging machines of which only a part is illustrated in the following, namely the region in which the individual cigarette groups are wrapped in the inner wrappings.

Figures 6, 7, 8:
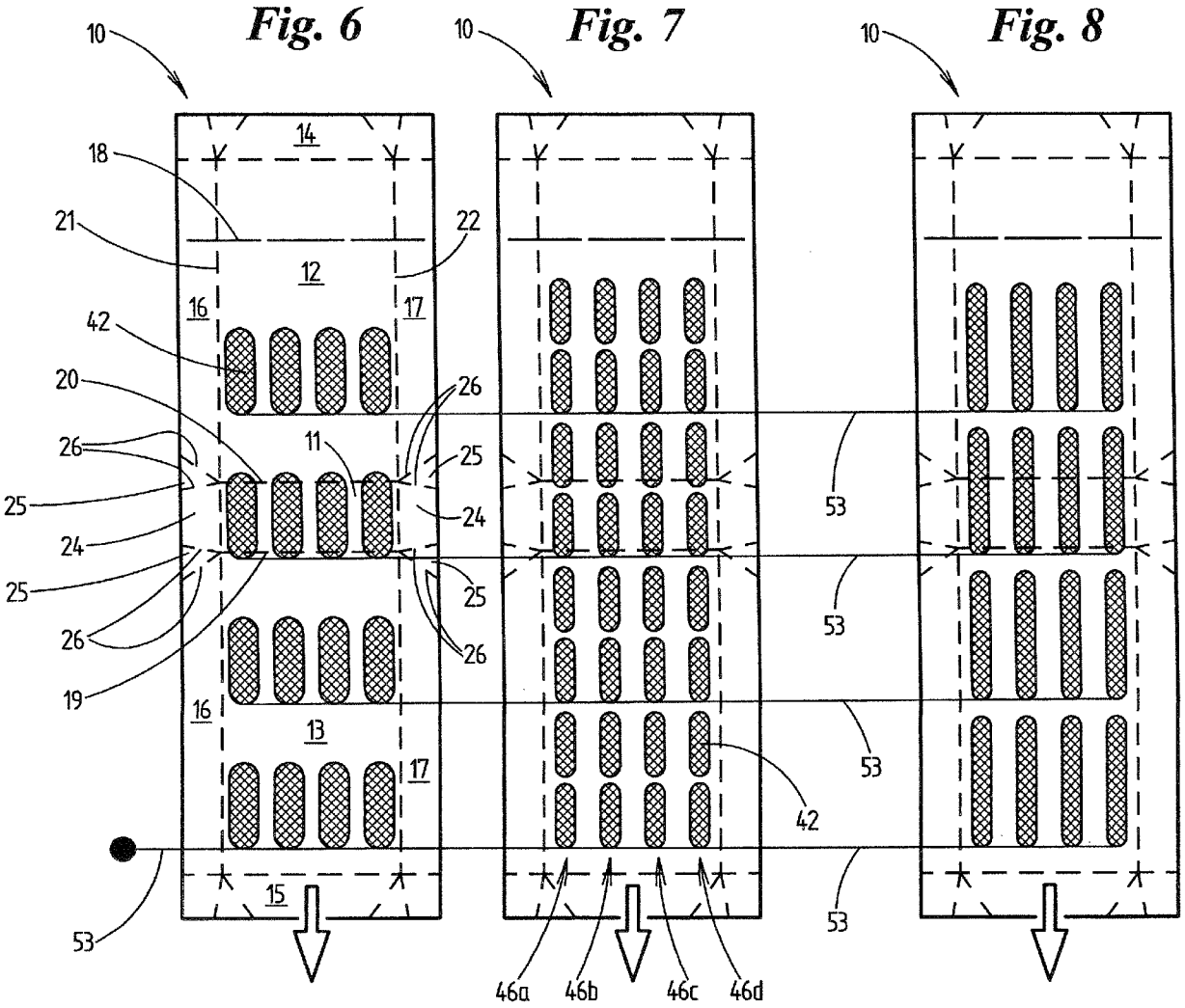
FIGS. 6-8 show plan views of blanks which have been provided with menthol portions, within the scope of the method according to the invention.

FIGS. 6-8 show blanks 10 prior to the respective cigarette groups or cigarette formations 27 being wrapped with the blanks 10 while forming the inner wrapping. Such blanks 10, also referred to as inner-liner blanks, are known per se. Details pertaining to these are disclosed in, for example, EP 1 016 593 A1, the contents of which are integrated into the present application.

The blank 10 disposes of a base wall 11, a front wall 12, a rear wall 13, end folding tabs 14, 15 which form an opposing upper end wall, and side folding tabs 16 and 17 which form the narrow side walls. A transversely oriented perforation 18 is placed in the region of the front wall 12, delimiting an end-side region of the blank 10 and serving as what is referred to as a flap, which is torn off by gripping the end wall tab 14 when using the pack for the first time. Although the blank 10 is composed of thin packaging material, it is provided with stamped lines, namely with two parallel, transversely oriented transverse stamped lines 19, 20 which delimit the base wall 11 in relation to the front wall 12 and the rear wall 13. The transverse stamped lines 19, 20 form base-side folding edges. Furthermore, longitudinal stamped lines 21 and 22 exist which run in the longitudinal direction of the blank 10 and which delimit the lamellar side folding tabs 16 or 17 in relation to the remaining part of the blank 10. The longitudinal stamped lines 21 and 22 also serve as folding edges. The blank 10 furthermore has base folding tabs 24 and folding gussets 25 which are arranged beside the former. The base folding tabs 24 and the folding gussets 25 are separated from one another by folding lines 26.

The cigarette groups 27 to be wrapped with the blanks 10 are conveyed by means of a cigarette conveyor 28, having entrainers 29 which are equally spaced apart, along a blank subassembly 30.

In the region of the blank subassembly 30, the blanks 10 are successively infed and kept ready for acquisition by a cigarette group 27. The blanks 10 here are severed from a continuous material web 31 of paper, tinfoil or another packaging material by a severing element 32 and kept ready as a "curtain" in a transverse position to the direction of movement of the cigarette group 27.

The blank 10, in the region of the blank subassembly 30, is positioned such that the cigarette group 27, with end faces, in the present case with the filter-free cigarette ends, lying in front in the conveying direction, grips the blank 10 in the region of its base wall 11, specifically between the two transverse stamped lines 19, 20. In the continuation of the conveying movement of the cigarette group 27, the blank is folded in a U-shape. For this purpose, a mouthpiece (not illustrated) having corresponding guides above and below the movement path of the cigarette groups 27 is arranged in the region of the blank subassembly 30.

The severing element 32 comprises a knife roller 33 which is driven in rotation and which, by means of a severing knife 34*a* which is attached on the circumferential face of said knife roller 33, interacts with a stationary severing means 34*b* which severs continuous material web 31 into the individual blanks 10.

The knife roller 33 introduces the perforation line 18 into the blank 10 by way of the perforation knife 35.

For introducing the transverse stamping lines 19, 20, the blank subassembly 30 has a stamping roller 36, on the circumference of which the stamping tools, specifically two transversely oriented rib-like stamping protrusions 37, are attached. The stamping roller 36, in relation to the conveying direction, is arranged downstream of the knife roller 33. The transverse stamping lines 19, 20 are correspondingly placed on the material web 31, wherein, during the stamping procedure, as a counter-pressure element, a pressure roller 38 lies against the circumference of the stamping roller 36, or against the material web 31.

A further stamping assembly, which is arranged upstream and with which the longitudinal stamping lines 21, 22 are placed in the material web 31, is not shown.

The blanks 10 which are severed from the material web 31 are transferred from the knife roller 33 to rotating suction disks 39. The suction discs 39 are provided along the circumference with suction bores 40 and grip the blank 10 by lateral edges. For guiding the blank during this suction/rotation-conveying movement, a guide element 41 is provided, specifically a guide plate on which the blank 10 bears, at least in regions. The cigarette groups 27 are conveyable between the suction disks 39, wherein the blank 10, in the region of the base wall 11, is gripped by the cigarette group 27 and is pulled away from the suction disks 39.

It is an important special feature that, upstream of the severing element 32, in the present case caterpillar-shaped aromatic portions 42, in the present case menthol, are applied to the material web 31 which is being driven continuously or cyclically.

Said aromatic portions 42 are applied to the side which is in the following referred to as the inner side 43 of the material web 31, which inner side 43, in the wrapped state of the cigarette group 27 at a later stage, faces inward, i.e. toward the cigarette group 27. On account thereof it is ensured that the (volatile) aromatic can migrate into the individual cigarettes of the cigarette group 27 during the time in which said cigarettes are arranged in the pack.

For applying the aromatic portions 42, the inner side 43 of the material web 31 is assigned an application element 44. In the present case, the application element 44 comprises a plurality of (four) valves 45*a-d* lying beside one another and having nozzles 62 with valve openings, or nozzle openings 52, with which parallel rows or tracks 46*a-d* of individual aromatic portions 42 can be applied.

Figure 3:
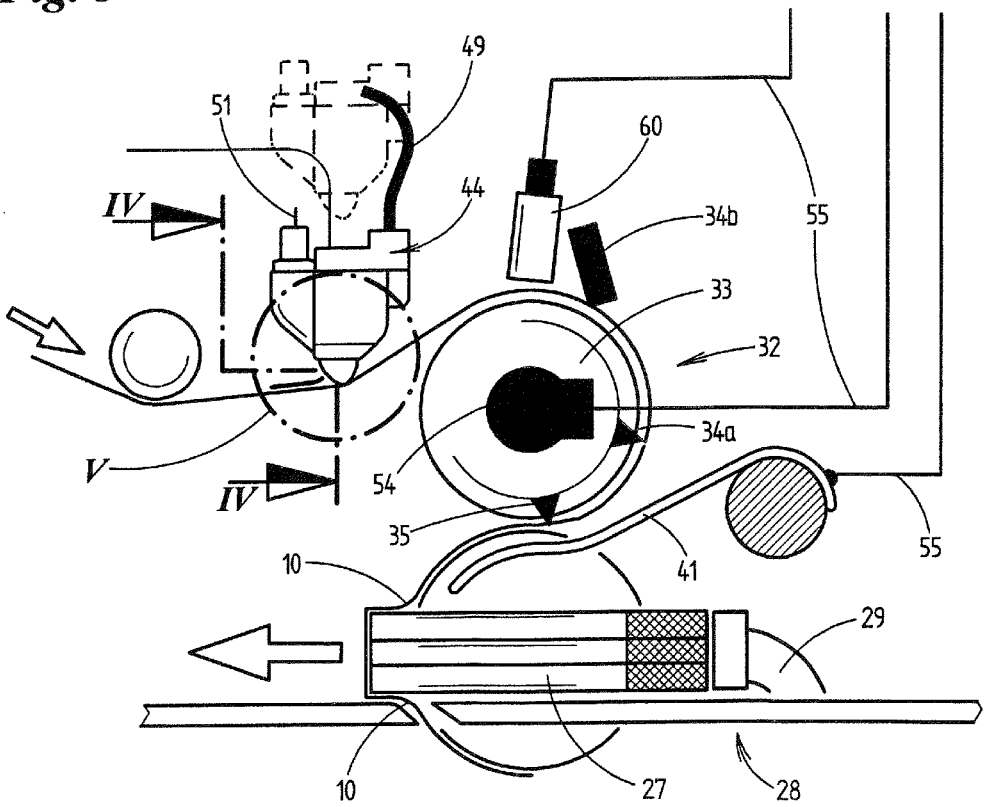
FIG. 3 shows the schematic illustration of an alternative embodiment of the method according to the invention.
Figure 4:
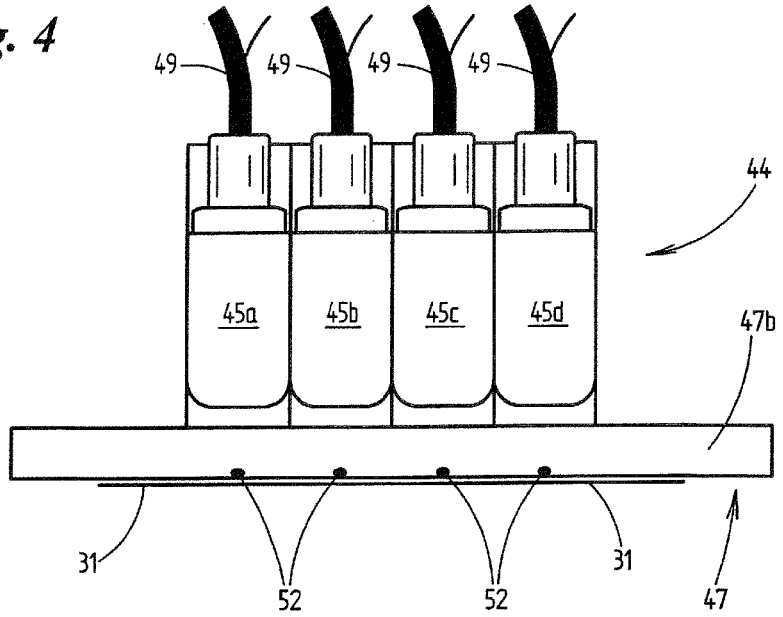
FIG. 4 shows a section along the section line IV-IV in FIG. 3.
Figure 5:
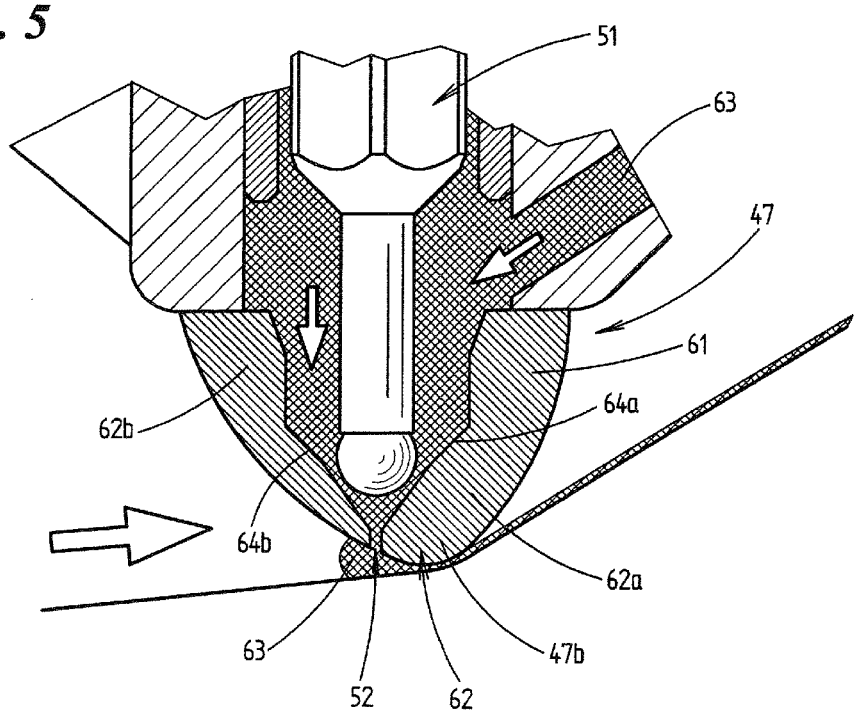
FIG. 5 shows the detail V of FIG. 3 in an enlarged illustration.

A particular embodiment of the invention is shown in FIGS. 3-5. The differences relate to, but are not limited to, in particular the configuration of the valves 45*a-d* of an application element 44, which, in contrast to the valves 45*a-d* of the embodiment according to FIG. 1, of which only the front valve 45*a* can be seen, have special features which will be described in yet more detail later.

Insofar as no explicit mention is made of the differences of the individual embodiments, the following explanations apply to both embodiments.

Figure 1:
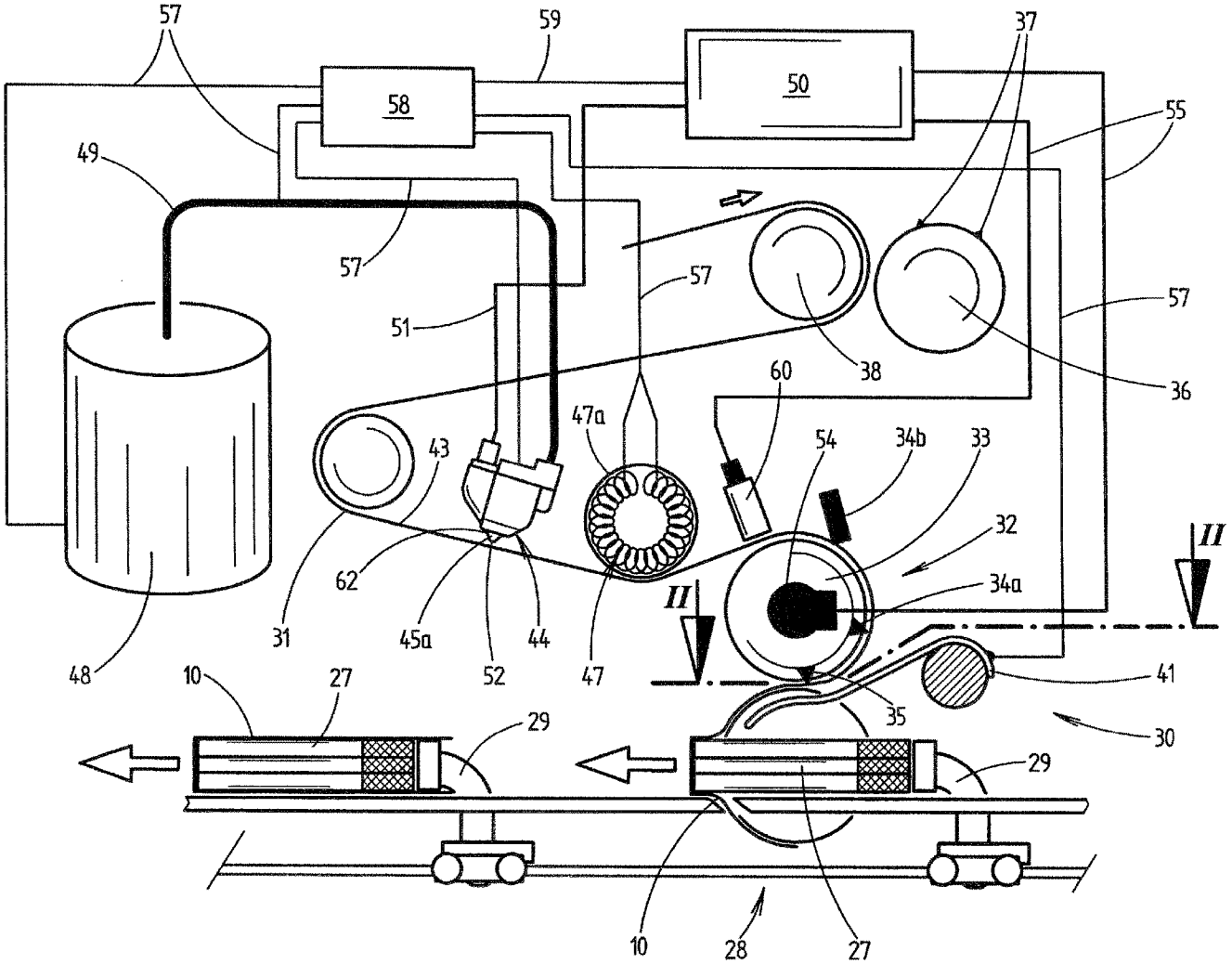
FIG. 1 shows a schematic overall view of the cycle of the method according to the invention, in which the menthol portions are applied to a material web.
Figure 2:
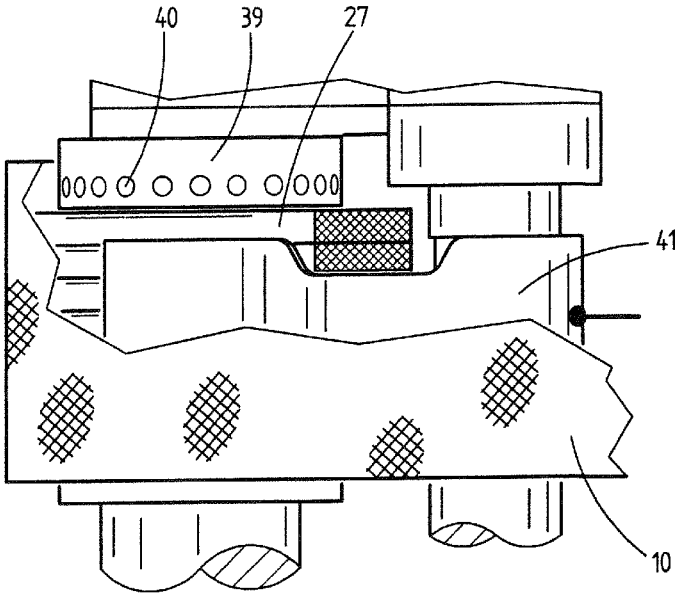
FIG. 2 shows a section along the section line II-II of FIG. 1.

According to the embodiment of FIGS. 1, 2, the glue valves 45*a-d* are arranged at a small distance from the material web 31, in the present case above said material web 31.

In order to prevent the aromatic portions 42 from contaminating the downstream assemblies, in particular the severing element 32, a processing means 47, in this case a deflection roller 47*a*, is arranged downstream of the application element 44 in this embodiment.

The material web 31 is guided along the processing means 47, specifically in such a manner that the inner side 43 of the former, having the aromatic portions 42 applied to it, lies against the circumferential face of the deflection roller 47 during the deflection operation. In this case, the width of the deflection roller, or the circumferential face of the deflection roller 47, respectively, is adapted to the material web 31, or to the application pattern of the individual aromatic portions 42 on the material web 31, in such a manner that all portions 42, or all parallel rows 46*a-d* of portions 42, cf. FIGS. 6-8, are pressed flat by the deflection roller 47. For this purpose, the material web 31 is guided under specific tension along the deflection roller 47. As a result of the portions 42 being pressed flat, they are widened somewhat in comparison to their state prior to being pressed flat, cf. FIG. 6.

The circumferential length of the rotating deflection roller 47 is adapted to the length of the blanks 10 to be severed in each case from the material web 31. The circumferential length, in the present case, corresponds to said length. Correspondingly, the same regions of the roller 47 in each case touch the same regions of the respective blanks 10, or of the aromatic portions 42 arranged on the blanks 10. Should, in the course of production, specific fractions of the aromatic portions 42 be transferred to the roller 47, they will only be deposited at specific positions of the roller 47. In other words, each blank 10, from which aromatic fractions are transferred to the roller 47, would transfer its fractions to the same roller region or roller position.

In consequence, the roller 47 would always transfer the deposit pattern being created on its circumferential face to the same positions of the subsequent blanks 10 of the continuous material web 31. In the optimal case, the deposit pattern on the roller 47 would be such that the transfer of deposits to the subsequent blanks 10 takes place only at those positions of the respective blank 10 on which there are aromatic portions 42 anyway.

In contrast to the embodiment according to FIGS. 1, 2, the use of a deflection roller as a processing means 47 can be dispensed with in the embodiment according to FIGS. 3, 4 and 5. In place of the deflection roller, a strip 61, which spreads flat the individual portions 42 immediately after application of the portions 42, is used.

The strip 61 extends transversely to the material web 31, and specifically while generating a specific material-web tension, as in the case of the solution having deflection roller 47, cf. FIG. 5. The strip 61 is configured as a ceramic strip and heated in order to prevent aromatic deposits on the strip. In the present case, the strip 61 is arranged immediately on the application element 44.

In more exact terms, the strip 61 is part of each outlet nozzle 62 of each valve 45*a-d*. The strip 61 here forms a wall 62*a* of each nozzle 62. A rear side 64*a*, when viewed in the conveying direction, of the strip 61 here in each case forms one of the inner sides of the nozzle walls which delimit the nozzle outlet openings 52. One of the further nozzle walls can be identified in FIG. 5, specifically the nozzle wall 62*b*, lying opposite the wall 62*a* and having the corresponding inner side 64*b*.

Prior to being applied to the material web 31, the liquid aromatic is situated in the space enclosed by the nozzle walls, or by their corresponding inner sides.

Finally, it is provided that the application element 44, according to FIGS. 3-5, is pivotable from an operating position, in which the contact strip of the contact nozzle 62 touches the material web 31 under tension, into a resting position; cf. the dashed contour of the application element 44 in FIG. 3.

In both embodiments of the invention described, the aromatic (the menthol), which is applied to the material web 31 by means of the application element 44, originates from an aromatic reservoir 48. From the reservoir 48, the liquid aromatic is fed via one or more lines 49 (for example, hose lines) to the application element 44, in particular to the valves 45*a-d* thereof.

The signals, by means of which the application element 44 is controlled for dispensing the individual portions 42, originate from a controller 50, to which the application element 44 is connected with one or more signal lines 51. Ultimately, the controller 50 controls the opening of a closure element 51 in the respective valve 45*a-d*, which closure element 51, in the closed state of the respective valve 45*a-d*, closes the respective nozzle opening 52 and, in the opened state, deblocks it.

Generation of the individual portions 42 takes place in a particular manner in that the total amount of individual portions 42 which are applied per blank 10 to the material web 31 is irrespective of the machine speed of the device, or of the material-web speed. In other words, the application element 44, or the individual valves 45*a-d* of the application element 44, is/are controlled such that the total amount of aromatic, which is in each case applied to the respective blank 10 of the material web 31, is constant, irrespective of the material-web speed/machine speed. This is usually effected in that the opening times of the valves 45*a-d* are adapted to the respective machine speed or web speed.

It is further provided that, in the case of an identical total amount per portion per blank 10, the number of individual portions 42 which are applied to a blank 10 is adjusted as a result of the requirement of the machine speed of the packaging machine and/or of the material-web speed, or is dependent thereon.

It may be provided, for example, that at a first, lower machine speed and/or material-web speed, more individual portions per blank 10 have to be applied to the material web 31 than at a second, higher speed. On account thereof, an excessive accumulation of aromatics on one and the same position at relatively low machine speed or material-web speed can be prevented.

In FIG. 6 the application pattern of the individual aromatic portions 42 of a blank 10 is shown. This application pattern corresponds to a second, higher machine speed and/or web speed than the application pattern of the blank 10 of FIG. 7.

In FIG. 8 an application pattern is shown in which the speed of the material web, or the machine speed, is set yet again higher than in the variant of FIG. 6. In the case of an identical opening time of the valves 45*a-d* of the application element 44, correspondingly longer aromatic portions 42 are created.

A further special feature of controlling the application operation is that the regions of the blanks 10 are preferably reserved, i.e. not populated with portions 42, which after the wrapping of the cigarette groups 27 at a later stage, cover the filters of the cigarettes from the front, from the side and from above. To this end, the end folding tabs 14, 15, which cover the cigarette filters from above, or at the end sides, respectively, are reserved in FIGS. 6 to 8. The regions which cover the filters of the cigarettes at the front and at the sides are furthermore reserved.

By way of the transverse lines 53 in FIGS. 6-8 the points in time are in each case visualized at which the respective valves 45*a-d* are opened. In the variant of FIG. 7, the valves are additionally opened one more time between two points in time 53, in order to generate twice the number of portions 42.

In order to register the material-web speed, the knife roller 33 is assigned a rotary encoder 54 which registers the revolutions of the knife roller 33. The signals of the rotary encoder 54 are transmitted via a signal line 55 to the controller 50. Using the revolutions of the knife roller 33, the controller 50 calculates the material-web speed.

In order to prevent aromatic deposits from forming on individual elements which are in contact with the aromatic, said elements, according to a further special feature, are heated or heatable.

In this manner, for example, the deflection roller 47, the application element 44, or the individual valves 45*a-d*, the reservoir 48 and the lines 49 are equipped with corresponding heating elements, in particular heating wires, which are connected to a central heating assembly 58 via suitable power lines 57. The heating assembly 58 comprises, inter alia, a required voltage source for supplying the heating elements. On the other hand, the heating assembly comprises a suitable heating modulator which is additionally connected to the controller 50 via a line 59.

A further special feature is a sensor 60 which is connected to the controller 50 via a signal line 55. By means of this sensor 60, one or more characteristic features of the portions 42 applied to the material web 31 can be registered and evaluated for verification in the controller 50. In the present case, this is specifically a gloss sensor 60 which registers the gloss values of the individual portions 42. Should the registered gloss values deviate from specific, predefined nominal values, an error signal is generated in the controller 50. If applicable, the packaging machine will be shut down.

LIST OF REFERENCE SIGNS

10 Blank
11 Base wall
12 Front wall
13 Rear wall
14 End folding tab
15 End folding tab
16 Side folding tab
17 Side folding tab
18 Perforation
19 Transverse stamped line
20 Transverse stamped line
21 Longitudinal stamped line
22 Longitudinal stamped line
24 Base folding tab
25 Folding gusset
26 Folding line
27 Cigarette group
28 Cigarette conveyor
29 Entrainer
30 Blank subassembly
31 Material web
32 Severing element
33 Knife roller
34*a* Severing knife
34*b* Severing means
35 Perforation knife
36 Stamping roller
37 Stamping protrusions
38 Pressure roller
39 Suction disc
40 Suction bore
41 Guide element
42 Aromatic portion
43 Inner side
44 Application element
45*a-d* Valve
46*a-d* Track

47 Processing means
47*a* Deflection roller
47*b* Strip
48 Application material reservoir
49 Line
50 Controller
51 Closure element
52 Outlet opening
53 Transverse line
54 Rotary encoder
55 Signal line
57 Line
58 Heating unit
59 Line
60 Sensor
61 Strip
62 Outlet nozzle
62*a* Wall
62*b* Wall
63 Aromatics
64*a* Inner side
64*b* Inner side

What is claimed is:

1. A method for manufacturing items of packaging for groups of smokable articles, the items of packaging each having a wrapping of a thin packaging material, the method comprising:

severing a material web of the packaging material into individual blanks;

wrapping the groups of smokable articles in each case with the individual blanks;

applying flavoring and/or aromatic portions for the smokable articles to the material web; and reducing the flavoring and/or aromatic portions in height, after application, at least in regions, by a processing means such that the flavoring and/or aromatic portions are spread flat and/or pressed flat by the processing means, wherein the processing means is a roller having a circumferential length corresponding to a length of the individual blanks such that same regions of the roller respectively touch in each case same regions of respective individual blanks, and of respective flavoring and/or aromatic portions on the individual blanks, whereby the individual blanks transfer same fractions of their flavoring and/or aromatic portions to same specific positions of the roller creating a deposit pattern of the flavoring and/or aromatic portions on a circumferential face of the roller, whereby the roller always transfers the deposit pattern to same positions of subsequent individual blanks of the material web, and whereby the deposit pattern on the roller is such that the transfer of flavoring and/or aromatic portions to the subsequent individual blanks takes place only at positions of each respective individual blank on which there previously have been applied the flavoring and/or aromatic portions.

2. The method as claimed in claim 1, wherein the roller reduces the heights of the flavoring and/or aromatic portions prior to the severing of the material web.

3. The method as claimed in claim 1, wherein the flavoring and/or aromatic portions are applied to a side of the material web that, after the wrapping of each of the groups of smokable articles with a corresponding one of the individual blanks, faces inward toward the group of smokable articles.

4. The method as claimed in claim 1, wherein the roller is heatable.

5. The method as claimed in claim 1, wherein at least one parameter of the flavoring and/or aromatic portions applied to the material web is registered by means of a sensor for registering gloss values of the flavoring and/or aromatic portions applied to the material web.

6. The method as claimed in claim 1, wherein the smokable articles are filter cigarettes, wherein none of the flavoring and/or aromatic portions are applied to selected regions of the material web which, after the wrapping of the groups of filter cigarettes with corresponding individual blanks, cover specific regions of filters of the filter cigarettes.

7. The method as claimed in claim 6, wherein a constant number of flavoring and/or aromatic portions is applied to each of the individual blanks, the number of flavoring and/or aromatic portions applied to each of the individual blanks being a result of a machine speed of a machine for carrying out the method and/or a speed of the material web moving in the machine.

8. The method as claimed in claim 7, wherein the number of flavoring and/or aromatic portions applied to the material web at a first, lower machine speed of the machine and/or a first, lower speed of the material web is greater than the number of flavoring and/or aromatic portions applied to the material web at a second, higher machine speed of the machine and/or a second, higher speed of the material web.

9. A device for manufacturing items of packaging for groups of smokable articles, the items of packaging each having a wrapping of a thin packaging material, the device comprising:

a severing element with which a material web of the packaging material is severable into individual blanks;

a blank subassembly in a region of which the groups of smokable articles are wrappable with the individual blanks in each case;

an application element which is arranged upstream of the severing element and with which flavoring and/or aromatic portions for the smokable articles are applied to the material web; and a processing means with which the flavoring and/or aromatic portions, after application, are at least in regions reduced in height such that the flavoring and/or aromatic portions are spread flat and/or pressed flat by the processing means, wherein the processing means is a roller having a circumferential length corresponding to a length of the individual blanks which are in each case to be severed from the material web, such that same regions of the roller respectively touch in each case same regions of respective individual blanks, and of respective flavoring and/or aromatic portions on the individual blanks;

whereby the individual blanks transfer same fractions of their flavoring and/or aromatic portions to same specific positions of the roller creating a deposit pattern of the flavoring and/or aromatic portions on a circumferential face of the roller, whereby the roller always transfers the deposit pattern to same positions of subsequent individual blanks of the material web, and whereby the deposit pattern on the roller is such that the transfer of flavoring and/or aromatic portions to the subsequent individual blanks takes place only at positions of each respective individual blank on which there previously have been applied the flavoring and/or aromatic portions.

10. The device as claimed in claim 9, wherein the roller is heatable.

* * * * *